US010490941B2

(12) United States Patent
Ruffini et al.

(10) Patent No.: US 10,490,941 B2
(45) Date of Patent: Nov. 26, 2019

(54) RF CONNECTOR FOR AN RF MODULE

(71) Applicant: TE CONNECTIVITY CORPORATION, Berwyn, PA (US)

(72) Inventors: Nicholas Paul Ruffini, Lancaster, PA (US); Keith Edwin Miller, Manheim, PA (US); Eric Douglas Springston, II, Hershey, PA (US); Kyle Gary Annis, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/872,342

(22) Filed: Jan. 16, 2018

(65) Prior Publication Data

US 2019/0221969 A1 Jul. 18, 2019

(51) Int. Cl.

| | |
|---|---|
| ***H01R 13/631*** | (2006.01) |
| ***H01R 13/633*** | (2006.01) |
| ***H01R 13/642*** | (2006.01) |
| ***H01R 13/502*** | (2006.01) |
| ***H01R 13/426*** | (2006.01) |
| ***H01R 24/40*** | (2011.01) |

(52) U.S. Cl.

CPC ..... *H01R 13/6315* (2013.01); *H01R 13/426* (2013.01); *H01R 13/502* (2013.01); *H01R 13/633* (2013.01); *H01R 13/642* (2013.01); *H01R 24/40* (2013.01)

(58) Field of Classification Search

CPC ..... H01R 13/6315; H01R 13/426; H01R 13/502; H01R 13/633; H01R 13/642; H01R 24/40

See application file for complete search history.

(56) References Cited

U.S. PATENT DOCUMENTS

| | | | | |
|---|---|---|---|---|
| 4,944,568 A * | 7/1990 | Danbach | G02B 6/3847 | 250/227.11 |
| 5,516,303 A * | 5/1996 | Yohn | H01R 13/6315 | 439/248 |
| 5,769,652 A * | 6/1998 | Wider | H01R 13/6315 | 439/248 |
| 6,132,244 A * | 10/2000 | Leeman | H01R 24/50 | 439/541.5 |
| 6,699,054 B1 * | 3/2004 | Critelli | H01R 13/6315 | 439/248 |
| 7,234,967 B2 * | 6/2007 | Weidner | H01R 9/0515 | 439/581 |
| 7,607,929 B1 * | 10/2009 | Nguyen | H01R 13/6315 | 439/246 |
| 7,896,655 B1 * | 3/2011 | Blasick | H01R 13/112 | 439/581 |

(Continued)

*Primary Examiner* — Briggitte R. Hammond

(57) ABSTRACT

An RF module includes a housing including connector cavities and having a rear wall with lands adjacent openings. The RF module includes RF connectors received in the connector cavities each having a conductive shell and a dielectric body positioning a center contact in the shell. The RF connector has a spring surrounding the shell between front and rear flanges and a rear retainer having a front rim. The RF connector is received in the opening such that the front rim engages the rear wall to retain the RF connector in the corresponding opening. The RF connector is spring loaded in the connector cavity to allow the RF connector to float in the connector cavity.

23 Claims, 9 Drawing Sheets

(56) References Cited

U.S. PATENT DOCUMENTS

| | | | | |
|---|---|---|---|---|
| 8,002,574 | B1 * | 8/2011 | Yi | H01R 13/582 439/455 |
| 8,235,749 | B2 * | 8/2012 | Weldon | H01R 13/74 439/565 |
| 8,282,415 | B1 * | 10/2012 | Foltz | H01R 13/514 439/579 |
| 8,851,934 | B2 * | 10/2014 | McAlonis | H01R 13/6453 439/680 |
| 9,160,096 | B2 * | 10/2015 | Morley | H01R 13/514 |
| 9,608,388 | B2 * | 3/2017 | Kondo | H01R 24/38 |
| 9,735,519 | B2 * | 8/2017 | Yi | H01R 9/05 |
| 2014/0206221 | A1 * | 7/2014 | Morley | H01R 13/518 439/370 |
| 2018/0332726 | A1 * | 11/2018 | Zhu | H01R 13/447 |
| 2018/0366844 | A1 * | 12/2018 | Beganovic | H01R 9/0515 |

* cited by examiner

RF CONNECTOR FOR AN RF MODULE

BACKGROUND OF THE INVENTION

The subject matter herein relates generally to RF connectors for RF modules.

Due to their favorable electrical characteristics, coaxial cables and connectors have grown in popularity for interconnecting electronic devices and peripheral systems. Typically, one connector is mounted to a circuit board of an electronic device at an input/output port of the device and extends through an exterior housing of the device for connection with a coaxial cable connector. Each connector include an inner conductor coaxially disposed within an outer conductor, with a dielectric material separating the inner and outer conductors.

A typical application utilizing coaxial cable connectors is a radio-frequency (RF) application having RF connectors designed to work at radio frequencies in the UHF and/or VHF range. RF connectors are typically used with coaxial cables and are designed to maintain the shielding that the coaxial design offers. RF connectors are typically designed to minimize the change in transmission line impedance at the connection by utilizing contacts that have a short contact length. The connectors have a short mating distance and, particularly when using multiple connectors in a single insert, typically include a pre-compressed spring to ensure the connectors are pushed forward and the contacts are engaged.

Known RF connectors having springs are not without disadvantages. For instance, assembly of the connectors in the housing may be difficult. For example, the spring is typically retained by a washer and the spring is loaded onto the shell in the contact cavity and then assembled using the washer to hold the spring on the shell. However, improper loading of the spring or washer may lead to loss of one or more of the components, such as when the spring forces the washer off the end of the connector, leading to loss of the washer and/or the spring or injury to the assembler, such as when the washer is ejected toward the assembler's eye. Furthermore, disassembly and removal of the connector may be difficult, such as when one or more of the connectors needs to be replaced.

A need remains for an RF module that may be assembled in a cost effective, safe and reliable manner.

BRIEF DESCRIPTION OF THE INVENTION

In one embodiment, an RF module is provided including a housing having walls defining connector cavities. The walls include a rear wall having a plurality of openings therethrough. The rear wall has lands adjacent the openings. The connector cavities are open opposite the rear wall to receive electrical connectors. The RF module includes RF connectors received in the connector cavities. The RF connectors are terminated to corresponding cables. Each RF connector has a conductive shell, a center contact and a dielectric body positioning the center contact in the shell. The shell has a front flange and a rear flange. The RF connector has a spring surrounding the shell between the front flange and the rear flange. The RF connector has a rear retainer at the rear flange having a front rim. The RF connector is received in the corresponding opening such that the front flange is located forward of the rear wall in the connector cavity and the rear flange is located rearward of the rear wall. The RF connector is received in the corresponding opening such that the front rim of the rear retainer engages the rear wall to retain the RF connector in the corresponding opening. The RF connector is spring loaded in the connector cavity to allow the RF connector to float in the connector cavity.

In another embodiment, an RF connector is provided including a shell extending between a mating end and a cable end. The shell has a front shell and a rear shell. The front shell has a front flange and the rear shell has a rear flange. The shell has a shell cavity. The rear shell is configured to be terminated to a coaxial cable. The front shell is configured to be mated with an electrical connector. The RF connector includes a center contact received in the shell cavity terminated to the coaxial cable and having a mating end configured to be mated with the electrical connector. The RF connector includes a dielectric body received in the shell cavity holding the center contact. The RF connector includes a spring surrounding the shell and positioned between the front flange and the rear flange and spring loaded in a connector cavity of a housing to allow the RF connector to float in the connector cavity. The RF connector includes a rear retainer coupled to the rear shell proximate to the rear flange. The rear retainer is axially movable relative to the rear flange. The rear retainer is rotatably fixed relative to the rear flange. The rear retainer has a front rim. The spring is spring biased against the front rim. The front flange is configured to be received in the connector cavity of the housing such that the front rim engages a rear wall of the housing to axially position the rear retainer relative to the housing.

In a further embodiment, an RF module is provided including a housing having cavity walls defining connector cavities and a rear wall at a rear of the connector cavities. The rear wall has a plurality of openings therethrough open to corresponding connector cavities. The rear wall has lands adjacent the openings. The connector cavities are open opposite the rear wall to receive electrical connectors in corresponding connector cavities. The RF module includes RF connectors received in the connector cavities. The RF connectors are terminated to corresponding cables. Each RF connector has a conductive shell, a center contact and a dielectric body positioning the center contact in the shell. The shell has a front flange and a rear flange. The front flange has outer edges facing the side walls and configured to engage the side walls to center the RF connector in the corresponding connector cavity for mating with the corresponding electrical connector. The RF connector has a spring surrounding the shell between the front flange and the rear flange. The RF connector has a rear retainer at the rear flange. The rear retainer has a front rim. The RF connector is received in the corresponding opening such that the front rim of the rear flange engages the rear wall to retain the RF connector in the corresponding opening. The RF connector is spring loaded in the connector cavity to allow the RF connector to float in the connector cavity.

In another embodiment, an RF module is provided including a housing having walls defining connector cavities extending between a mating end and a rear wall having a plurality of openings therethrough. The connector cavities are open at the mating end to receive electrical connectors. The RF module includes RF connectors received in the connector cavities being terminated to corresponding cables. Each RF connector has a conductive shell, a center contact and a dielectric body positioning the center contact in the shell. The shell has a front flange and a rear flange and a spring surrounding the shell between the front flange and the rear flange. The RF connector has a rear retainer forward of the rear flange being secured to the rear wall. The RF connector is received in the corresponding opening such that the front flange is located forward of the rear wall in the connector cavity and the rear flange is located rearward of the rear wall. The front flange has a plurality of projections extending to an outer edge of the front flange facing the walls of the housing defining the corresponding connector cavity to prevent significant lateral movement of the RF connector in the connector cavity. The RF connector is spring loaded in the connector cavity to allow the RF connector to axially float in the connector cavity.

DETAILED DESCRIPTION OF THE INVENTION

Figure 1:
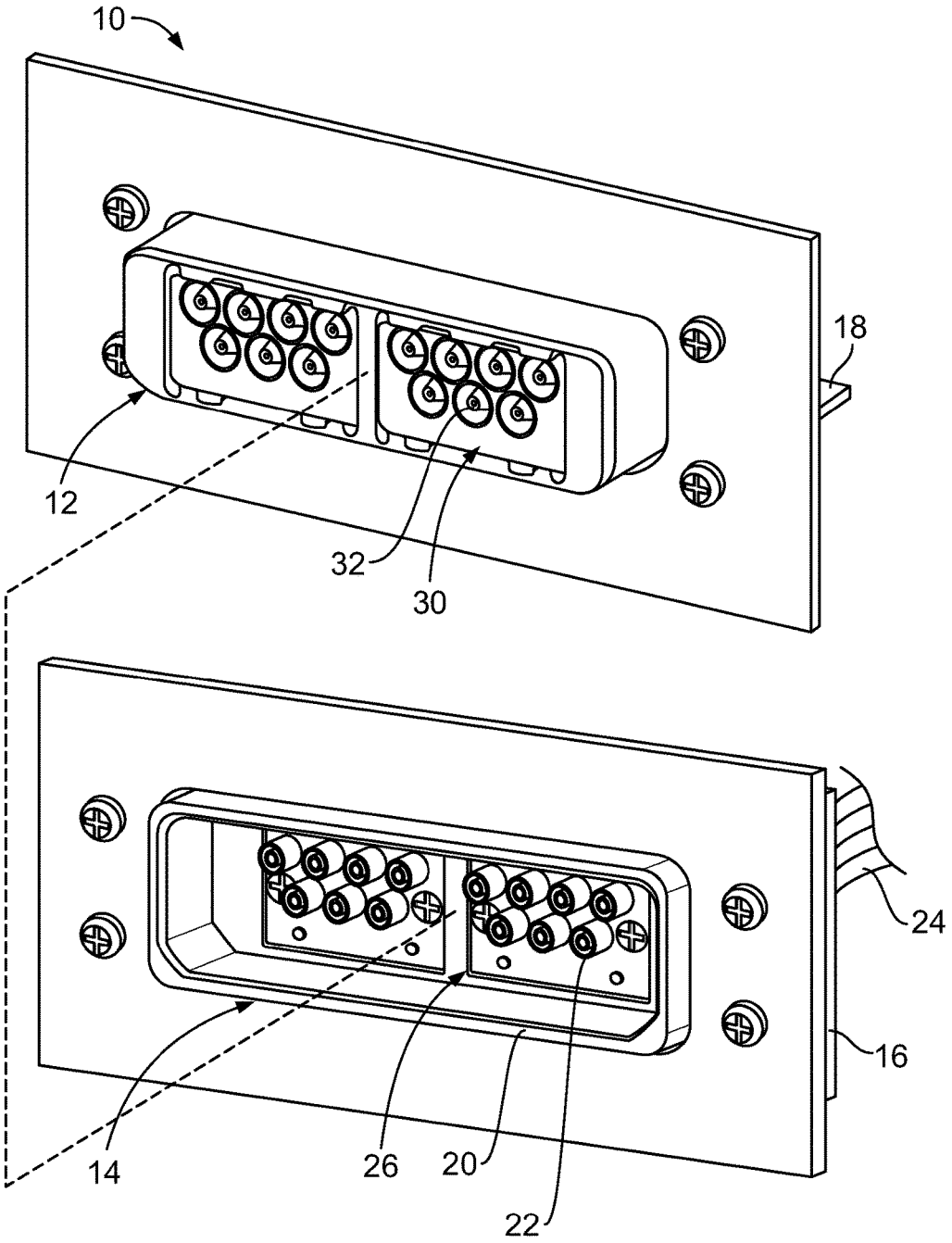
FIG. 1 illustrates an electrical connector system including an RF module and an electrical connector assembly formed in accordance with an exemplary embodiment.

FIG. 1 illustrates an electrical connector system 10 including an RF module 12 and an electrical connector assembly 14 formed in accordance with an exemplary embodiment. FIG. 1 shows front perspective views of both the RF module 12 and the electrical connector assembly 14, which are configured to be mated together along the phantom line shown in FIG. 1. In an exemplary embodiment, the electrical connector assembly 14 defines a motherboard assembly that is associated with a motherboard 16. The RF module 12 defines a daughtercard assembly that is associated with a daughtercard 18.

The electrical connector assembly 14 includes a housing 20 and a plurality of electrical connectors 22 held within the housing 20. Any number of electrical connectors 22 may be utilized depending on the particular application. In the illustrated embodiment, seven electrical connectors 22 are provided in two rows. In the illustrated embodiment, the electrical connectors 22 are cable mounted to respective coaxial cables 24. Alternatively, the electrical connectors 22 may be terminated to the motherboard 16. The electrical connectors 22 may be terminated to the motherboard 16 with the motherboard 16 oriented parallel to the mating face as shown in FIG. 1, or alternatively, the motherboard 16 may be at another angle, such as perpendicular and the electrical connectors 22 may be right angle electrical connectors 22. The housing 20 includes a mating cavity 26 that defines a receptacle for receiving the RF module 12.

In an exemplary embodiment, the RF module 12 defines a plug that may be received within the mating cavity 26. The RF module 12 includes a housing 30 and a plurality of RF connectors 32 held within the housing 30. The RF connectors 32 are cable mounted to respective coaxial cables. The RF module 12 and electrical connector assembly 14 are mated with one another such that the electrical connectors 22 mate with the RF connectors 32. In alternative embodiments, the RF module 12 and electrical connector assembly 14 are both board mounted, or alternatively, one of the RF module 12 and electrical connector assembly 14 are cable mounted, while the other is board mounted.

Figure 2:
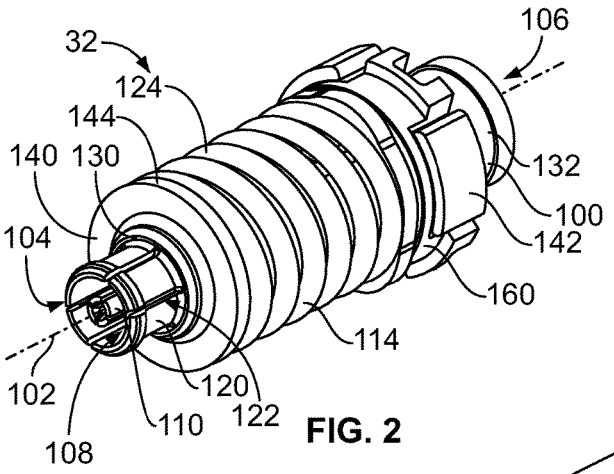
FIG. 2 is a perspective view of an RF connector for the RF module in accordance with an exemplary embodiment.
Figure 3:
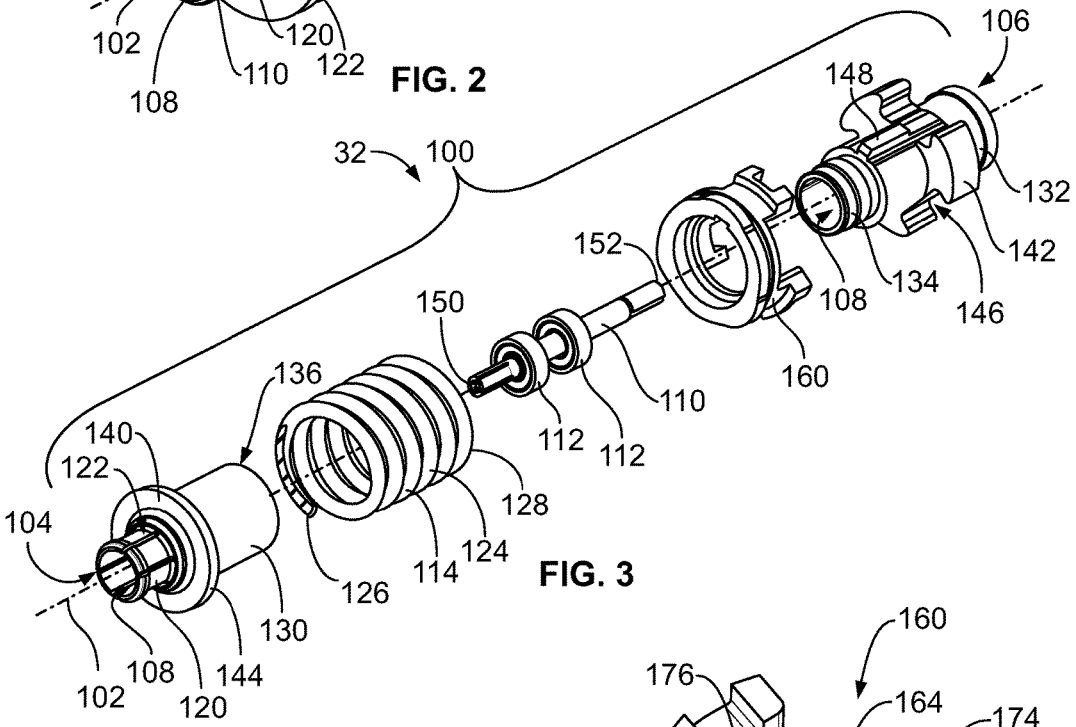
FIG. 3 is an exploded view of the RF connector in accordance with an exemplary embodiment.

FIG. 2 is a perspective view of one of the RF connectors 32. FIG. 3 is an exploded view of the RF connector 32. The RF connector 32 includes a shell 100 extending along a central longitudinal axis 102 between a mating end 104 and a cable end 106. The shell 100 defines a shell cavity 108. The RF connector 32 includes a center contact 110 held within the shell cavity 108. In an exemplary embodiment, a dielectric body 112 is positioned between the shell 100 and the contact 110. In an exemplary embodiment, the shell 100 is formed from a conductive material, such as a metal material, and the dielectric body 112 electrically separates the contact 110 and the shell 100. The shell 100 defines an outer contact with the center contact 110 and the shell 100 defining the outer contact being coaxial. The RF connector 32 includes a spring 114 concentrically surrounding a portion of the shell 100. The RF connector 32 includes a rear retainer 160 used to retain the spring 114 in position with respect to the shell 100. The rear retainer 160 is used to secure the RF connector 32 to the housing 30 (shown in FIG. 1) of the RF module 12 (shown in FIG. 1).

The shell 100 is generally cylindrical in shape and may be stepped along the length having portions of different diameters. The mating end 104 defines a plug may be tapered or stepped such that a shell at the mating end 104 is smaller than along other portions of the shell 100. The shell 100 includes a tines 120 at the mating end 104 configured to be received within the electrical connector 22 (shown in FIG. 1). The tines 120 are separated by gaps 122 and are movable with respect to one another such that the tines 120 may be deflected toward one another to reduce the diameter of the mating end 104 for mating with the electrical connector 22.

Deflection of the tines 120 may cause a friction fit with the electrical connector 22 when mated.

The spring 114 has a helically wound body 124 extending between a front end 126 and a rear end 128. The rear end 128 faces the rear retainer 160. The spring 114 is compressible axially. In an exemplary embodiment, the shell 100 is a multi-piece shell and the spring 114 may be loaded between the pieces. For example, the shell 100 includes a front shell 130 and a rear shell 132. A nose 134 of the rear shell 132 is received in a hood 136 of the front shell 130. The front shell 130 may be secured to the rear shell 132, such as by a press-fit and/or crimping and/or soldering. The dielectric body 112 is held within the shell cavity 108 defined by the front shell 130 and/or the rear shell 132.

The front shell 130 includes a front flange 140 and the rear shell 132 includes a rear flange 142. The front flange 140 includes an outer edge 144 having a diameter greater than other adjacent portions of the front shell 130. The outer edge 144 may extend around the entire perimeter of the front flange 140. Alternatively, the front flange 140 may include a plurality of projections at the outer edge 144, where the projections extend further radially outward to define the outer edge 144. In an exemplary embodiment, the outer edge 144 may have a diameter approximately equal to the diameter of the connector cavities that receive the RF connectors 32 to center the RF connectors 32 in the connector cavities for mating with the electrical connectors 22 (shown in FIG. 1). In an exemplary embodiment, the rear flange 142 includes a plurality of pockets 146 that receive portions of the rear retainer 160. In an exemplary embodiment, the rear shell 132 includes one or more keys 148 for keyed mating with the rear retainer 160. In the illustrated embodiment, the rear shell 132 includes a single key extending radially outward from a side of the rear shell 132. In the illustrated embodiment, the key 148 is an elongated protrusion; however, the key 148 may have other shapes in alternative embodiments. In the illustrated embodiment, the key 148 is aligned with one of the pockets 146; however, the key may be offset from the pockets 146 in alternative embodiments. Optionally, the key 148 may be shaped to allow axial movement of the shell 100 relative to the rear retainer 160. The key 148 may be shaped to restrict rotational movement of the shell 100 relative to the rear retainer 160.

The contact 110 is held within the shell cavity 108 by the dielectric body 112. The contact 110 includes a mating end 150 and a terminating end 152. The mating end 150 is configured to mate with a center contact 154 (shown in FIG. 7) of the electrical connector 22. The mating end 150 is positioned proximate to the mating end 104 of the shell 100. The terminating end 152 is configured to be terminated to a cable, such as, to a center conductor (not shown) of a coaxial cable. The rear shell 132 is configured to mechanically and/or electrically connected to the cable, such as, to the cable braid, the cable insulator and/or the cable jacket.

Figure 4:
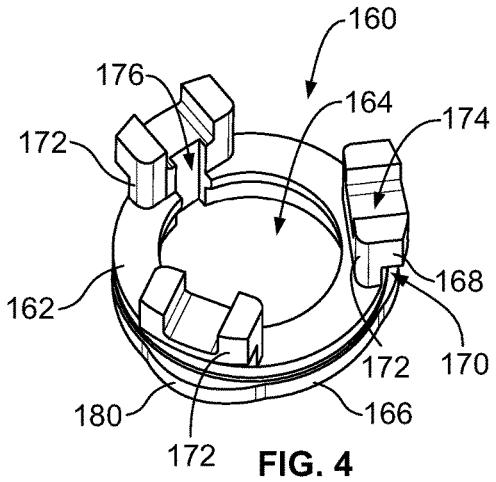
FIG. 4 is a rear perspective view of a rear retainer of the RF connector in accordance with an exemplary embodiment.

FIG. 4 is a rear perspective view of the rear retainer 160 in accordance with an exemplary embodiment. The rear retainer 160 includes a retainer body 162 having an opening 164. The opening 164 is configured to receive a portion of the shell 100 (shown in FIG. 3). The rear retainer 160 includes a front rim 166 and a rear rim 168 with a channel 170 formed therebetween. The channel 170 is provided along the exterior perimeter of the rear retainer 160. The channel 170 is configured to receive a portion of the housing 30 (shown in FIG. 1).

In an exemplary embodiment, the rear retainer 160 includes extensions 172 at the rear of the rear retainer 160. The extensions 172 are spaced apart along the outer perimeter of the rear retainer 160. In the illustrated embodiment, three extensions 172 are provided spaced equidistant apart. Greater or fewer extensions 172 may be provided in alternative embodiments. In another alternative embodiment, rather than having individual extensions, the rear retainer may extend entirely circumferentially around the opening 164 at the rear. The extensions 172 define the rear rim 168. In an exemplary embodiment, the extensions 172 include channels 174 at the rear. The channels 174 are configured to receive a removal tool for removing the RF connector 32 from the housing 30.

In an exemplary embodiment, the rear retainer 160 includes a keyway 176 for keyed mating with the shell 100. In the illustrated embodiment, the keyway 176 extends along the retainer body 162 and along one of the extensions 172. The keyway 176 extends axially. Optionally, multiple keyways 176 may be provided in alternative embodiments.

In an exemplary embodiment, the rear retainer 160 includes one or more lobes 180 at the front of the rear retainer 160. The lobes 180 may be provided at the front rim 166. The lobes 180 are bumps or protrusions that increase the width or diameter of the rear retainer 160 at the lobes 180. Any number of lobes 180 may be provided in various embodiments. In the illustrated embodiment, three lobes 180 are provided spaced equidistant around the perimeter of the front rim 166. In the illustrated embodiment, the lobes 180 are curved having varying thickness being thinner at the ends of the lobes 180 and thicker at the middle of the lobes 180. Other shapes are possible in alternative embodiments. The lobes 180 are used for mating with the housing 30, such as described in further detail below.

Figure 5:
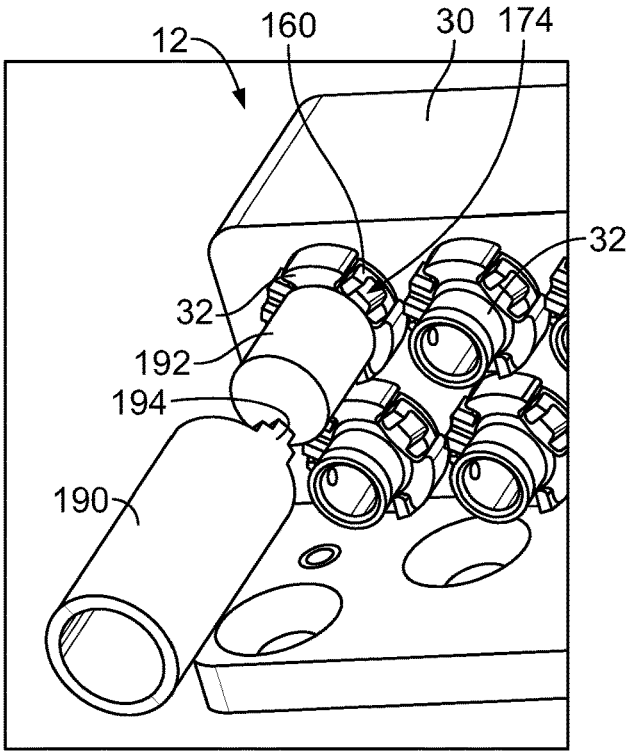
FIG. 5 is a rear perspective view of a portion of the RF module in accordance with an exemplary embodiment.

FIG. 5 is a rear perspective view of a portion of the RF module 12 showing a removal tool 190 configured for removing the RF connectors 32 from the housing 30. FIG. 5 illustrates a portion of one cable 192 extending from the corresponding RF connector 32. The removal tool 190 is configured to be loaded onto the cable 192 and brought into contact with the RF connector 32 to remove the RF connector 32. Optionally, the removal tool 190 may be a multi-piece tool, such as two halves that are coupled together around the cable 192. The removal tool 190 includes tabs 194 configured to engage the rear retainer 160. For example, the tabs 194 are configured to be received in the channels 174 at the rear of the rear retainer 160. In an exemplary embodiment, the removal tool 190 is used to rotate the rear retainer 160 to remove the RF connector 32 from the housing 30.

Figure 6:
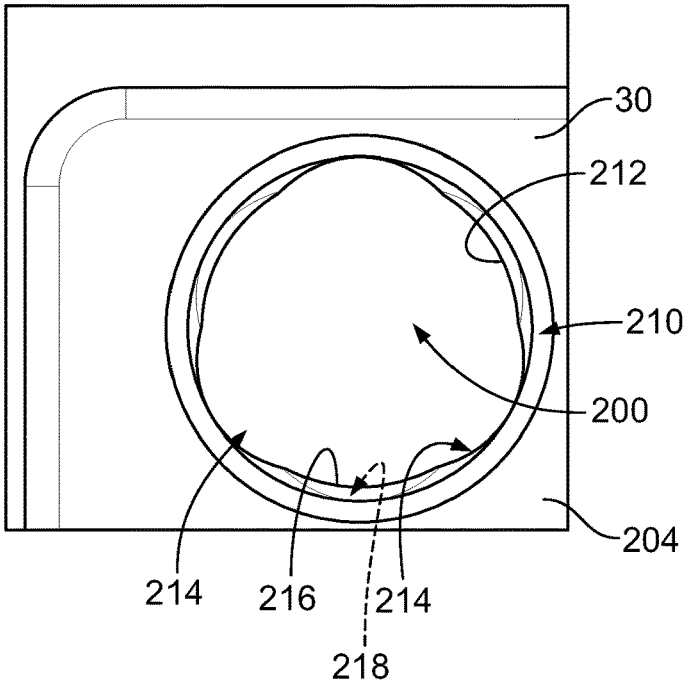
FIG. 6 is a rear perspective view of a portion of a housing of the RF module in accordance with an exemplary embodiment.

FIG. 6 is a rear perspective view of a portion of the housing 30. The housing 30 includes a plurality of walls defining connector cavities 200 that receive the RF connectors 32 (shown in FIG. 5). In an exemplary embodiment, the housing 30 includes a rear wall 204 on a back side of the housing 30. The rear wall 204 includes a plurality of openings 210 therethrough that provide access to the connector cavities 200. The RF connectors 32 are configured to extend through the openings 210 into the connector cavities 200. In an exemplary embodiment, the RF connectors 32 may be rear loaded into the connector cavities 200 through the openings 210.

In an exemplary embodiment, the rear wall 204 includes an interior surface 212 defining the opening 210. The rear wall 204 includes cutouts 214 and lands 216 adjacent the cutouts 214. The cutouts 214 are sized and shaped to receive corresponding lobes 180 of the RF connector 32 to allow the RF connector 32 pass through the opening 210. The RF connector 32 is configured to be rotated within the opening 210 to offset the lobes 180 from the cutouts 214. The RF connector 32 is rotated to align the lobes 180 with the lands 216 to secure the RF connector 32 in the connector cavity 200. Optionally, the lands 216 may include detents 218 (shown in phantom) that receive the lobes 180. The detents 218 provide an interference fit with the lobes 180 to resist inadvertent rotation of the RF connector 32.

Figure 7:
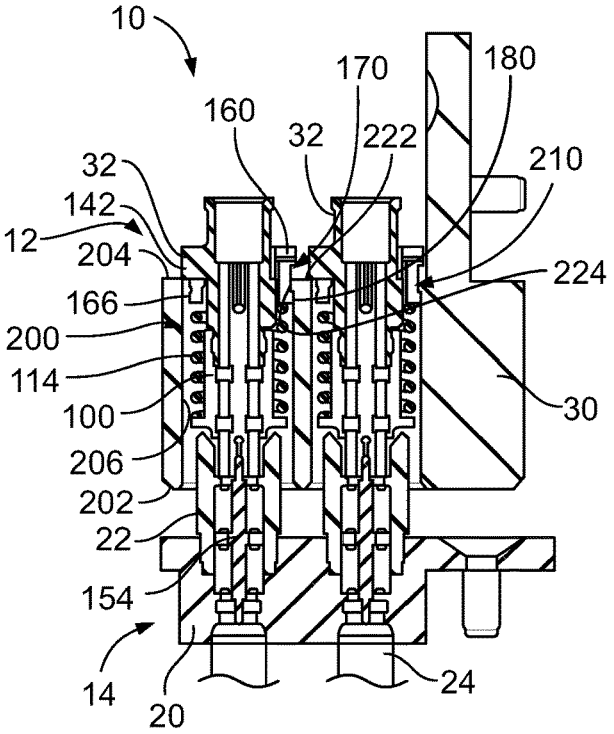
FIG. 7 is a partial cross sectional view of the connector system illustrating the RF module and electrical connector assembly in a partially mated position.

FIG. 7 is a partial cross sectional view of the connector system 10 illustrating the RF module 12 and electrical connector assembly 14 in a partially mated position where the electrical connector assembly 14 begins mating with the RF module 12. The RF module 12 includes the housing 30 and a plurality of the RF connectors 32. The walls of the housing 30 define the connector cavities 200. The housing 30 includes a mating end 202 opposite the rear wall 204. Some of the walls define interior walls 206 that separate adjacent connector cavities. Optionally, the connector cavities 200 may be cylindrical in shape.

The rear wall 204 includes a plurality of the openings 210 therethrough that provide access to the connector cavities 200. The RF connectors 32 extend through the openings 210 into the connector cavities 200. In an exemplary embodiment, a portion of the shell 100 is positioned outside of the housing 30 (e.g. rearward or behind the rear wall 204), and a portion of the shell 100 is positioned inside the connector cavity 200. The rear wall 204 includes first and second sides 222, 224, with the first side 222 facing rearward and outside of the housing 30 and the second side 224 facing forward and into the connector cavity 200. In an exemplary embodiment, the RF connector 32 is received in the connector cavity 200 such that the rear flange 142 faces and/or engages the first side 222 of the rear wall 204. The rear flange 142 defines a stop against the rear wall 204 that limits forward movement of the RF connector 32 relative to the housing 30. In an exemplary embodiment, the rear retainer 160 is coupled to the rear wall 204. The rear retainer 160 is loaded into the opening 210 and coupled to the rear wall 204. For example, the channel 170 of the rear retainer 160 receives the rear wall 204. The lobes 180 engage the second side 224 of the rear wall 204. The spring 114 engages the front rim 166 and pushes the front rim 166 against the second side 224 of the rear wall 204. In an exemplary embodiment, the spring 114 is biased against the rear retainer 160 to hold the RF connector 32 relative to the rear wall 204.

The electrical connector assembly 14 includes the housing 20 and a plurality of the electrical connectors 22. The electrical connectors 22 extend from the housing 20 for mating with corresponding RF connectors 32. For example, the electrical connectors 22 may be received in corresponding connector cavities 200. The electrical connectors 22 are connected to the coaxial cables 24.

Each electrical connector 22 includes a shell 230, a dielectric body 232 received in the shell 230 and one of the contacts 154 held by the dielectric body 232. The dielectric body 232 electrically isolates the contact 154 from the shell 230. The shell 230 includes a mating end 236 having an opening 238 that receives the RF connector 32 during mating. The shell 230 includes a terminating end 240 that is terminated to the housing 20.

Figure 8:
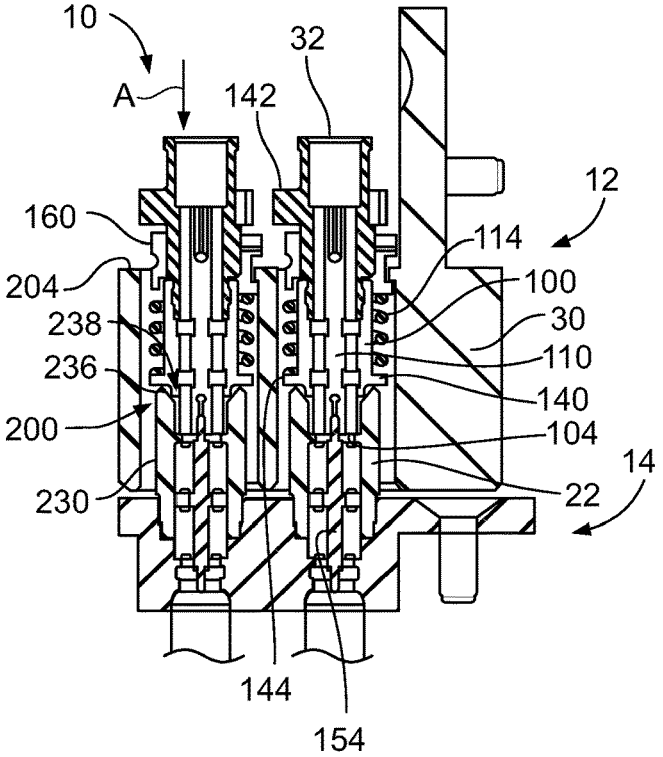
FIG. 8 is a partial cross sectional view of the connector system illustrating the RF module and electrical connector assembly in a mated position.

FIG. 8 is a partial cross sectional view of the connector system 10 illustrating the RF module 12 and electrical connector assembly 14 in a mated position. During mating, the RF module 12 and the electrical connector assembly 14 are mated in a mating direction, shown in FIG. 8 by an arrow A. As the RF module 12 is mated with the electrical connector assembly 14, the RF connectors 32 mate with the electrical connectors 22. In the mated position, the mating end 104 of the RF connector 32 is received in the opening 238 of the electrical connector 22. The mating end 104 may be resiliently held within the opening 238. In the mated position, the contact 110 engages, and electrically connects to, the contact 154. In an exemplary embodiment, the shell 100 engages, and electrically connects to, the shell 230.

During mating, the spring 114 allows the RF connector 32 to float within the connector cavity 200 such that the RF connector 32 is capable of being repositioned with respect to the housing 30. Such floating or repositioning allows for proper mating of the RF connector 32 with the electrical connector 22. For example, the spring 114 may be compressed such that the relative position of the mating end 104 with respect to the rear wall 204 changes as the RF connector 32 is mated with the electrical connector 22. The rear flange 142 is pushed rearward away from the rear wall 204 when the spring 114 is compressed. The rear retainer 160 remains positioned at the rear wall 204. The shell 100 moves relative to the rear retainer 160 when mated with the electrical connector 22. The spring 114 is compressed between the front flange 140 and the rear retainer 160.

The front flange 140 maintains the position of the mating end 104 within the connector cavity 200 for mating with the electrical connector 22. For example, the outer edge 144 faces the wall defining the connector cavity 200 and may abut against the wall of the connector cavity 200 to center the RF connector 32 in the connector cavity 200. The outer edge 144 may limit significant lateral movement of the RF connector 32 within the connector cavity 200 within a tolerance that fits within the catch window defined by the opening 238 at the mating end 236 of the electrical connector 22.

Figure 9:
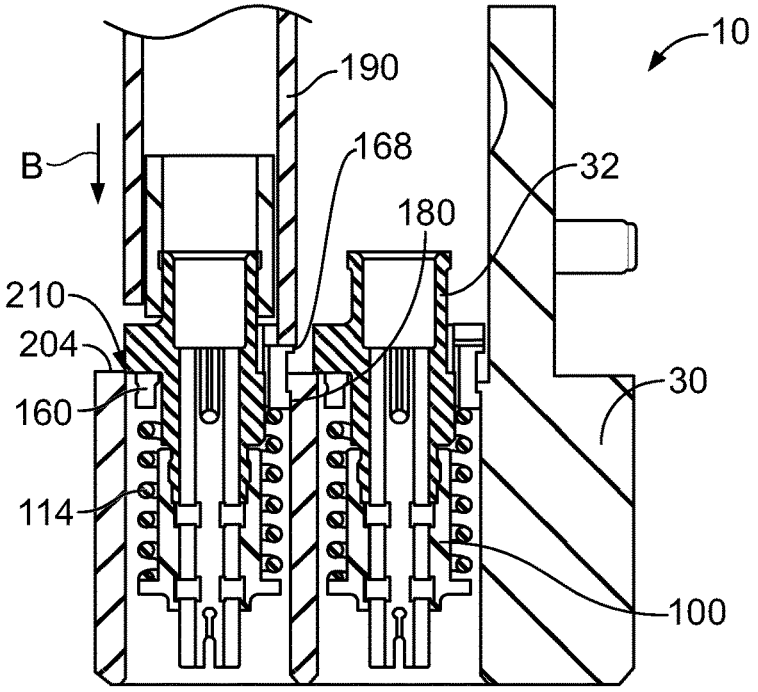
FIG. 9 is a partial cross sectional view of the connector system in accordance with an exemplary embodiment.

FIG. 9 is a partial cross sectional view of the connector system 10 illustrating the removal tool 190 configured to remove one of the RF connectors 32. The removal tool 190 engages the rear retainer 160. As the removal tool 190 is moved forward in a releasing direction, shown in FIG. 9 by the arrow B, the rear retainer 160 is pushed forward until the rear rim 168 engages the rear wall 204. The removal tool 190 is pushed forward to overcome the spring force of the spring 114. The removal tool 190 may be used to rotate the rear retainer 160 to rotate the lobes 180 relative to the rear wall 204. The removal tool 190 rotates the rear retainer 160 until the lobes 180 are aligned with the cutouts 214 (shown in FIG. 6) such that the RF connector 32 may be removed through the opening 210 in the rear wall 204. Optionally, the shell 100 may be rotated with the rear retainer 160.

In other various embodiments, the RF connector 32 may be removed without the use of the removal tool 190. For example, the RF connectors 32 may be hand removed from the rear of the housing 30, such as by the operator pushing and twisting the RF connectors 32 and then pulling the RF connectors 32 out through the opening 210 and the rear wall 204.

Figure 10:
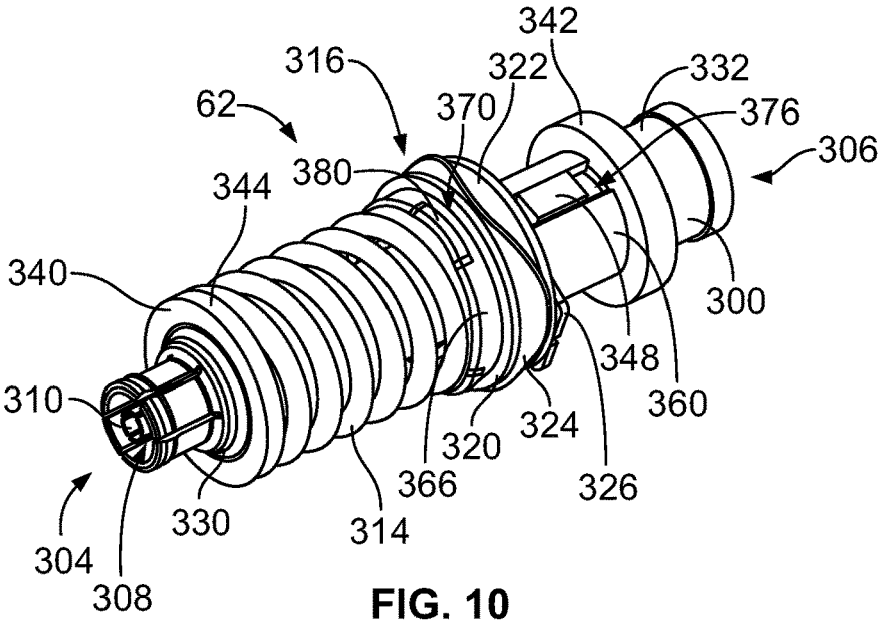
FIG. 10 is a perspective view of an RF connector in accordance with an exemplary embodiment.
Figure 11:
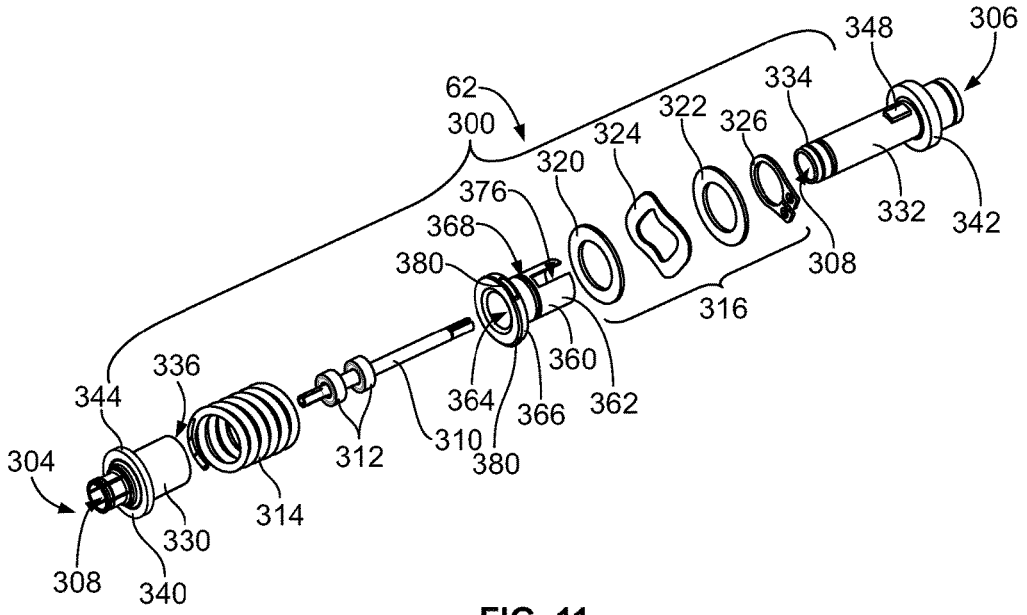
FIG. 11 is an exploded view of the RF connector in accordance with an exemplary embodiment.

FIG. 10 is a perspective view of an RF connector 62 in accordance with an exemplary embodiment. FIG. 11 is an exploded view of the RF connector 62. The RF connector 62 includes a shell 300 extending between a mating end 304 and a cable end 306. The RF connector 62 includes a center contact 310 held within the shell cavity 308. In an exemplary embodiment, a dielectric body 312 is positioned between the shell 300 and the contact 310. The RF connector 62 includes a spring 314 concentrically surrounding a portion of the shell 300. The RF connector 62 includes a rear retainer 360 used to retain the spring 314 in position with respect to the shell 300. The RF connector 62 includes a positioning element 316 for positioning the rear retainer 360, such as relative to a housing that holds the RF connector 62.

In an exemplary embodiment, the shell 300 is a multi-piece shell and the spring 314 may be loaded between the pieces. For example, the shell 300 includes a front shell 330 and a rear shell 332. A nose 334 of the rear shell 332 is received in a hood 336 of the front shell 330. The front shell 330 may be secured to the rear shell 332, such as by a press-fit and/or crimping and/or soldering. The dielectric body 312 is held within the shell cavity 308 defined by the front shell 330 and/or the rear shell 332.

The front shell 330 includes a front flange 340 and the rear shell 332 includes a rear flange 342. The front flange 340 includes an outer edge 344 having a diameter greater than other adjacent portions of the front shell 330. The outer edge 344 may extend around the entire perimeter of the front flange 340. Alternatively, the front flange 340 may include a plurality of projections at the outer edge 344, where the projections extend further radially outward to define the outer edge 344. In an exemplary embodiment, the rear shell 332 includes one or more keys 348 for keyed mating with the rear retainer 360.

The rear retainer 360 includes a retainer body 362 having an opening 364. The opening 364 is configured to receive a portion of the shell 300. The rear retainer 360 includes a front rim 366. The positioning element 316 is loaded onto the rear of the rear retainer 360 against the back side of the front rim 366. The rear retainer 360 includes a groove 368 rearward of the front rim 366. The positioning element 316 is configured to be coupled to the groove 368. For example, the positioning element 316 includes a first washer 320, a second washer 322 and a compression spring 324 between the first and second washers 320, 322. The compression spring 324 may be a wave spring. The positioning element 316 includes a retaining clip 326 configured to be received in the groove 368 to secure the positioning element 316 to the rear retainer 360. The retaining clip 326 may be a C-clip. The first washer 320 abuts against the front rim 366 and the retaining clip 326 abuts against the second washer 322 to hold the positioning element 316 on the rear retainer 360. The compression spring 324 is positioned between the first and second washers 320, 322.

In an exemplary embodiment, the rear retainer 360 includes a keyway 376 for keyed mating with the shell 300. The keyway 376 extends axially. Optionally, multiple keyways 376 may be provided in alternative embodiments.

In an exemplary embodiment, the rear retainer 360 includes one or more lobes 380 at the front of the rear retainer 360. The lobes 380 may be provided at the front rim 366. The lobes 380 are bumps or protrusions that increase the width or diameter of the rear retainer 360 at the lobes 380. Any number of lobes 380 may be provided in various embodiments. In the illustrated embodiment, three lobes 380 are provided spaced equidistant around the perimeter of the front rim 366. In the illustrated embodiment, the lobes 380 are curved having varying thickness being thinner at the ends of the lobes 380 and thicker at the middle of the lobes 380. Other shapes are possible in alternative embodiments. The lobes 380 are used for mating with the housing. In an exemplary embodiment, a channel 370 is defined between the lobes 380 and the first washer 320. The channel 370 is provided along the exterior perimeter of the front rim 366. The channel 370 is configured to receive a portion of the housing.

Figure 12:
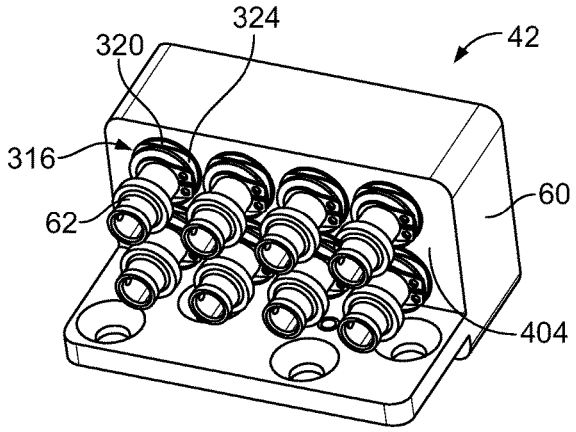
FIG. 12 is a rear perspective view of a portion of an RF module in accordance with an exemplary embodiment.

FIG. 12 is a rear perspective view of a portion of an RF module 42 in accordance with an exemplary embodiment. The RF module 42 includes a housing 60. The RF connectors 62 are coupled to the housing 60. In an exemplary embodiment, the RF connectors 62 may be rear loaded into connector cavities 400 (shown in FIG. 13) through openings 410 (shown in FIG. 13) in a rear wall 404 of the housing 60. The positioning element 316 positions the RF connector 62 on the rear wall 404. The first washer 320 may abut against the rear wall 404 when the RF connector 62 is coupled thereto. Optionally, the RF connector 62 may be twist locked to the rear wall 404 by loading a portion of the RF connector 62 into the connector cavity 400 and then rotating the RF connector 62 to a locked position. The compression spring 324 may bias the first washer 320 to hold the RF connector 62 in the locked position, such as to hold the rear wall 404 between the lobes 380 and the first washer 320. In an exemplary embodiment, the rear wall 404 includes cutouts and lands adjacent the cutouts similar to the rear wall 204 (shown in FIG. 6). The cutouts are sized and shaped to receive corresponding lobes 380 of the RF connector 62 to allow the RF connector 62 pass through the opening.

Figure 13:
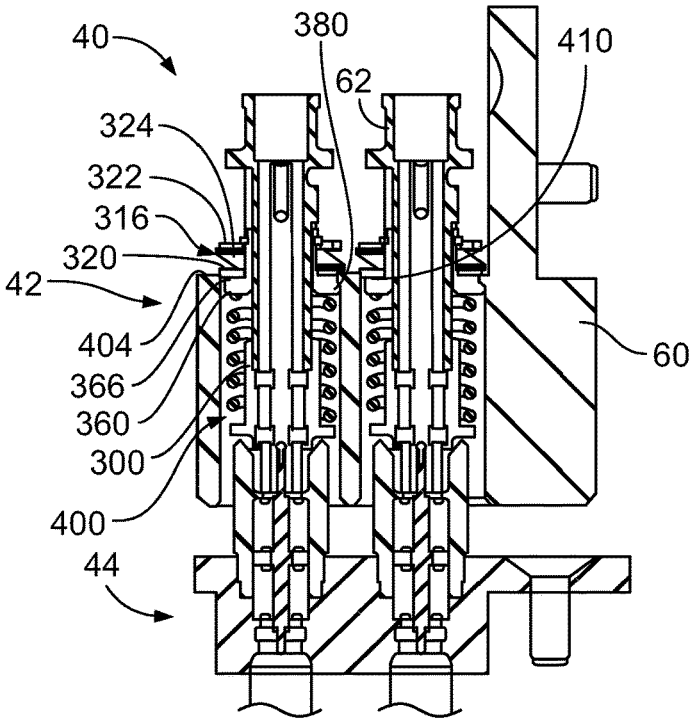
FIG. 13 is a partial cross sectional view of an electrical connector system in accordance with an exemplary embodiment illustrating an RF module and an electrical connector assembly in a partially mated position.

FIG. 13 is a partial cross sectional view of an electrical connector system 40 in accordance with an exemplary embodiment illustrating the RF module 42 and an electrical connector assembly 44 in a partially mated position where the electrical connector assembly 44 begins mating with the RF module 42. The electrical connector assembly 44 may be similar to or identical to the electrical connector assembly 14 (shown in FIG. 1). The RF module 42 includes the housing 60 and a plurality of the RF connectors 62. The walls of the housing 60 define the connector cavities 400. The rear wall 404 includes a plurality of the openings 410 therethrough that provide access to the connector cavities 400. The RF connectors 62 extend through the openings 410 into the connector cavities 400.

In an exemplary embodiment, the RF connector 62 is received in the connector cavity 400 until the positioning element 316 engages the rear wall 404. The front rim 366 is coupled to the rear wall 404. For example, the lobes 380 engage the rear wall 404.

During removal of the RF connector 62, the RF connector 62 may be twist unlocked, such as by hand. For example, the shell 300 may be pushed forward and then twisted to a clearance position in which the lobes are able to clear through the opening 410. When pressed forward, the compression spring 324 is compressed between the first and second washers 320, 322. The rear retainer 360 is rotated after being compressed until the lobes 380 are aligned with the cutouts such that the RF connector 62 may be removed through the opening 410 in the rear wall 404. Optionally, the shell 300 may be rotated with the rear retainer 360.

Figure 14:
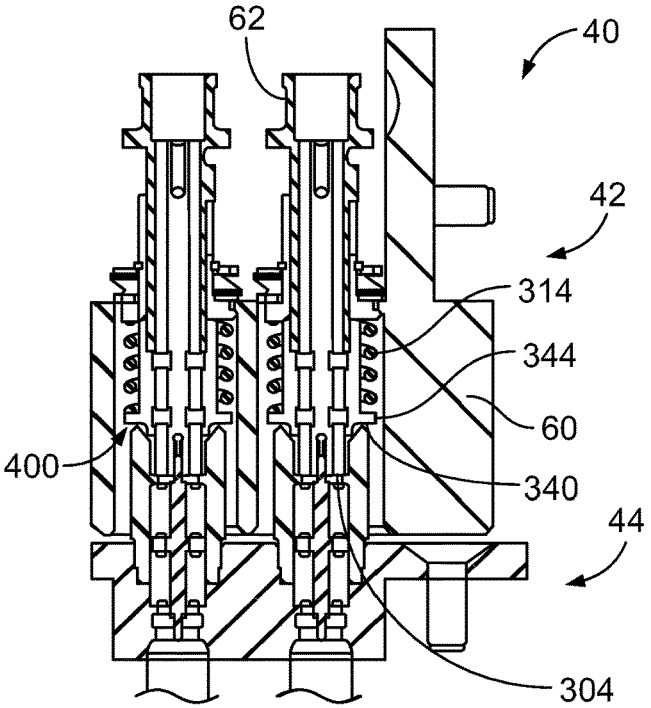
FIG. 14 is a partial cross sectional view of the connector system illustrating the RF module and electrical connector assembly in a mated position.

FIG. 14 is a partial cross sectional view of the connector system 40 illustrating the RF module 42 and electrical connector assembly 44 in a mated position. As the RF module 42 is mated with the electrical connector assembly 44, the RF connectors 62 mate with the electrical connectors 52. During mating, the spring 314 allows the RF connector 62 to float within the connector cavity 400 such that the RF connector 62 is capable of being repositioned with respect to the housing 60. The front flange 340 maintains the position of the mating end 304 within the connector cavity 400 for mating with the electrical connector 52. For example, the outer edge 344 faces the wall defining the connector cavity 400 and may abut against the wall of the connector cavity 400 to center the RF connector 62 in the connector cavity 400.

Figure 15:
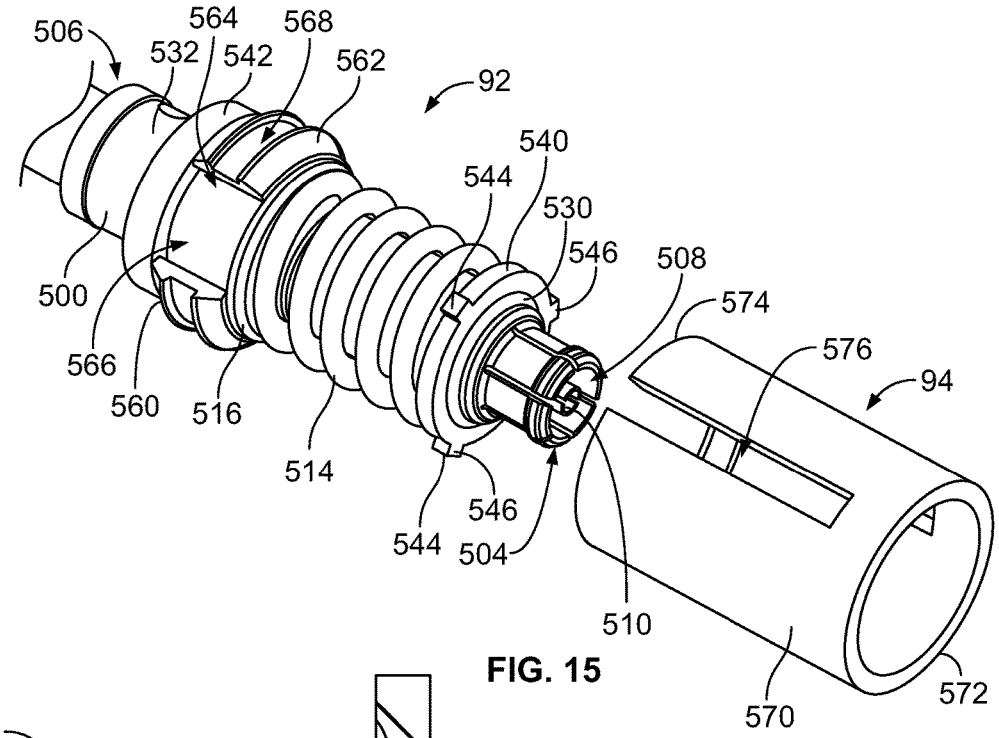
FIG. 15 is a perspective view of an RF connector in accordance with an exemplary embodiment.

FIG. 15 is a perspective view of an RF connector 92 in accordance with an exemplary embodiment. The RF connector 92 is configured to be snap loaded into a housing of an RF module, such as from the rear. The RF connector 92 is configured to be released by a removal tool 94 from the front. The RF connector 92 includes a shell 500 extending between a mating end 504 and a cable end 506. The RF connector 92 includes a center contact 510 held within the shell cavity 508. The RF connector 92 includes a spring 514 concentrically surrounding a portion of the shell 500. The RF connector 92 includes a rear retainer 560 used to secure the RF connector 92 in the housing of the RF module. The RF connector 92 includes a positioning element 516 for positioning the rear retainer 560 on the shell 500.

In an exemplary embodiment, the shell 500 is a multi-piece shell including a front shell 530 and a rear shell 532. The front shell 530 includes a front flange 540 and the rear shell 532 includes a rear flange 542. The front flange 540 includes an outer edge 544 having a diameter greater than other adjacent portions of the front shell 530. In an exemplary embodiment, the front flange 540 includes projections 546 defining the outer edge 544. The outer edge 544 defined by the projections may limit significant lateral movement of the RF connector 92 within the connector cavity of the housing within a tolerance that fits within the catch window of the mating electrical connector.

The rear retainer 560 includes a retainer body 562 having an opening 564. The opening 564 is configured to receive a portion of the shell 500. In an exemplary embodiment, the retainer body 562 is a snap ring configured to be snapably coupled to the rear wall. The retainer body 562 includes a slot 566 that allows the retainer body 562 to be compressible, such as to change a diameter of the retainer body 562, such as for coupling to the housing of the RF module and for removal from the housing of the RF module. The rear retainer 560 includes a groove 568 configured to receive the housing of the RF module to couple the rear retainer 560 to the housing.

The removal tool 94 includes a hollow cylindrical body 570 extending between a front 572 and a rear 574. The body 570 includes channels 576 open at the rear 574. The channels 576 are configured to receive corresponding projections 546. The removal tool 94 is configured to be loaded over the front end of the RF connector 92 to engage and release the retainer body 562. For example, the rear 574 engages the retainer body 562 to compress the retainer body 562 and release the rear retainer 560 from the housing of the RF module.

Figure 16:
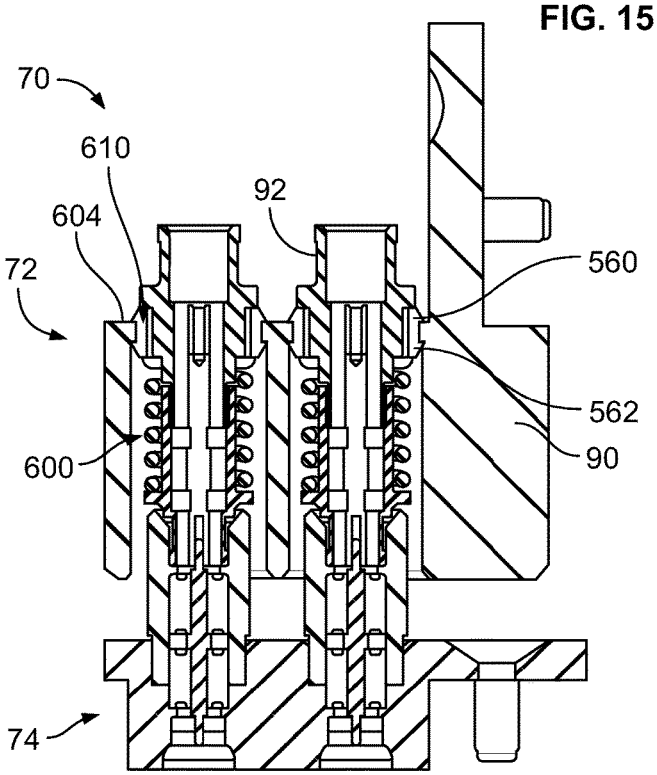
FIG. 16 is a partial cross sectional view of an electrical connector system in accordance with an exemplary embodiment illustrating an RF module and an electrical connector assembly in a partially mated position.
Figure 17:
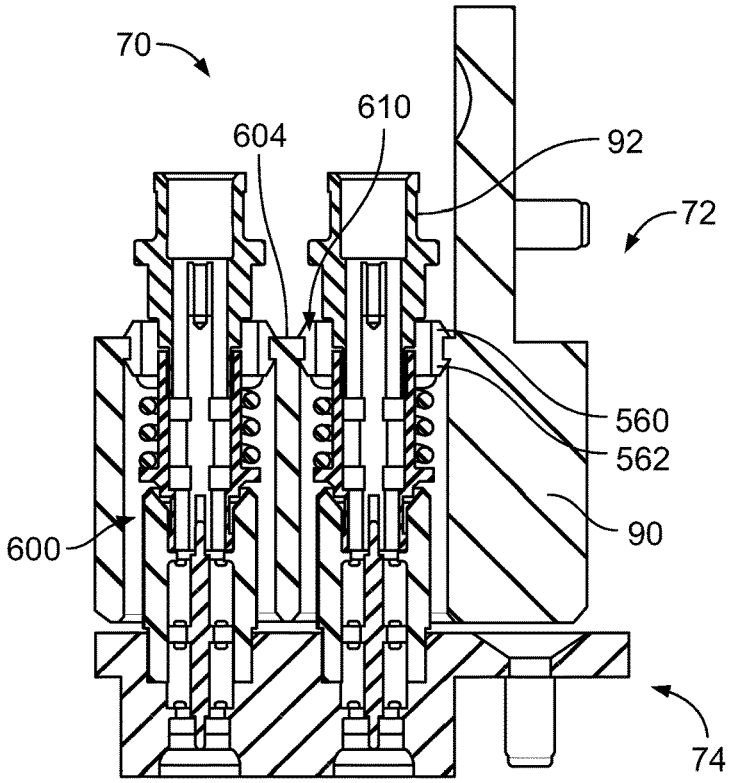
FIG. 17 is a partial cross sectional view of the connector system illustrating the RF module and electrical connector assembly in a mated position.

FIG. 16 is a partial cross sectional view of an electrical connector system 70 in accordance with an exemplary embodiment illustrating an RF module 72 and an electrical connector assembly 74 in a partially mated position where the electrical connector assembly 74 begins mating with the RF module 72. FIG. 17 is a partial cross sectional view of the connector system 70 illustrating the RF module 72 and electrical connector assembly 74 in a mated position. The electrical connector assembly 74 may be similar to or identical to the electrical connector assembly 24 (shown in FIG. 1). The RF module 72 includes a housing 90 and a plurality of the RF connectors 92. The walls of the housing 90 define connector cavities 600. A rear wall 604 includes a plurality of openings 610 therethrough that provide access to the connector cavities 600. The RF connectors 92 extend through the openings 610 into the connector cavities 600.

In an exemplary embodiment, the RF connector 92 is received in the connector cavity 600 until the rear retainer 560 engages the rear wall 604. The retainer body 562 is clipped to the rear wall 604.

Figure 18:
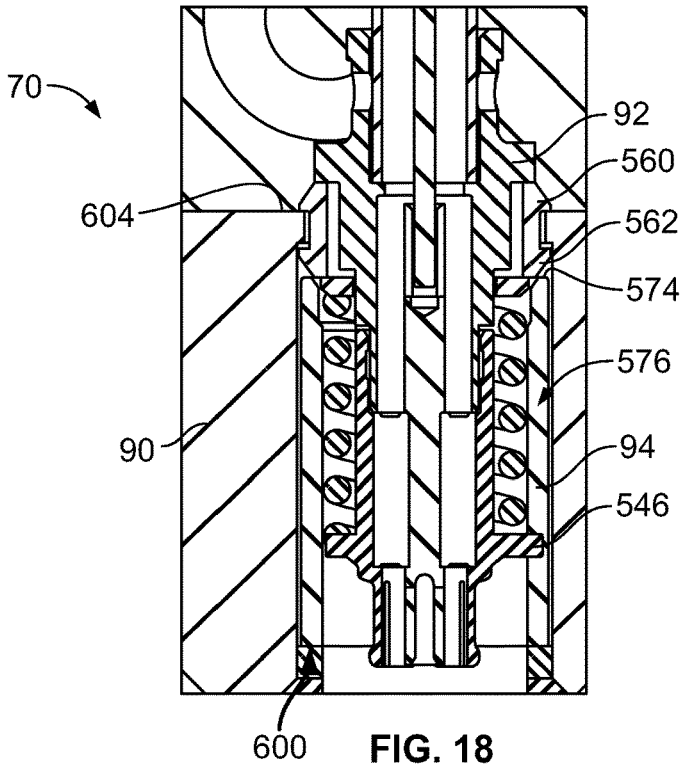
FIG. 18 is a partial cross sectional view of the connector system in accordance with an exemplary embodiment.

FIG. 18 is a partial cross sectional view of the connector system 70 illustrating the removal tool 94 being used to release the rear retainer 560 from the rear wall 604 of the housing 90. The removal tool 94 is loaded into the connector cavity 600 through the front. The channel 576 receives the projection 546. The rear 574 is pressed into the retainer body 562 to compress the retainer body 562 and release the rear retainer 560 from the rear wall 604. The RF connector 92 may then be pulled out of the connector cavity 600 from behind the rear wall 604.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 172(f), unless and until such claim limitations expressly use the phrase "means for" followed by a statement of function void of further structure.

What is claimed is:

1. An RF module comprising:

a housing having walls defining connector cavities, the walls comprising a rear wall having a plurality of openings therethrough, the connector cavities being open opposite the rear wall to receive electrical connectors;

RF connectors received in the connector cavities, the RF connectors being terminated to corresponding cables, each RF connector having a conductive shell, a center contact and a dielectric body positioning the center contact in the shell, the shell having a front flange and a rear flange, the RF connector having a spring surrounding the shell between the front flange and the rear flange, the RF connector having a rear retainer at the rear flange, the rear retainer having a front rim, the RF connector being received in the corresponding opening such that the front flange is located forward of the rear wall in the connector cavity and the rear flange is located rearward of the rear wall, the RF connector being received in the corresponding opening such that the front rim of the rear flange engages the rear wall to retain the RF connector in the corresponding opening, the RF connector being spring loaded in the connector cavity to allow the RF connector to float in the connector cavity.

2. The RF module of claim 1, wherein each opening includes a cutout and a land adjacent the cutout of the rear wall, the rear retainer having a lobe on the front rim, the lobe being received in the cutout, the rear retainer being rotated relative to the housing to offset the lobe from the cutout such that the front rim engages the rear wall.

3. The RF module of claim 2, wherein the spring biases the front rim against the rear wall to axially hold the rear retainer relative to the rear wall by a spring force.

4. The RF module of claim 1, wherein the rear retainer is twist-locked to the rear wall and is configured to be twist-unlocked from the rear wall.

5. The RF module of claim 1, wherein the RF connector further comprises a compression spring coupling the rear retainer to the rear wall, the compression spring being compressible to release the rear retainer from the rear wall to remove the RF connector from the housing.

6. The RF module of claim 5, wherein the compression spring is a wave spring positioned between a first washer and a second washer, the wave spring being compressible to release the front rim from the rear wall.

7. The RF module of claim 1, wherein the shell includes a key and the rear retainer includes a keyway receiving the key, the key being movable in the keyway to allow axial movement of the shell relative to the rear retainer, the key engaging the rear retainer to restrict rotational movement of the shell relative to the rear retainer.

8. The RF module of claim 1, wherein the rear retainer is configured to be released from the rear wall from an engaged position to a clearance position by axially shifting the rear retainer forward to separate the front rim from the rear wall and by rotatably shifting the rear retainer relative to the rear wall.

9. The RF module of claim 1, wherein the shell is rotated with the rear retainer between a clearance position and an engaged position, the front rim engaging the rear wall to couple the rear retainer to the rear wall in the engaged position, the front rim being disengaged from the rear wall to uncouple the rear retainer from the rear wall and allow removal of the RF connector from the housing in the clearance position.

10. The RF module of claim 1, wherein the front flanges include outer edges facing side walls of the connector cavities and configured to engage the side walls to center the RF connectors in the corresponding connector cavities for mating with the corresponding electrical connectors.

11. The RF module of claim 1, wherein the rear retainer includes extensions at a rear of the rear retainer, the extensions being received in corresponding pockets in the rear flange, the extensions having channels configured to receive a removal tool.

12. The RF module of claim 1, wherein the RF connector includes the shell and the spring are rear loaded into the corresponding connector cavity through the rear wall and are configured to be unloaded from the housing through the rear wall.

13. The RF module of claim 1, wherein the RF connector is configured to be released from behind the rear wall.

14. The RF module of claim 1, wherein the RF connector is configured to be released by a removal tool received in the connector cavity through a front of the housing.

15. An RF connector comprising:

a shell extending between a mating end and a cable end, the shell having a front shell and a rear shell, the front shell having a front flange, the rear shell having a rear flange, the shell having a shell cavity, the rear shell configured to be terminated to a coaxial cable, the front shell configured to be mated with an electrical connector;

a center contact received in the shell cavity, the center contact being terminated to the coaxial cable, the center contact having a mating end configured to be mated with the electrical connector;

a dielectric body received in the shell cavity, the dielectric body holding the center contact;

a spring surrounding the shell and positioned between the front flange and the rear flange, the spring being spring loaded in a connector cavity of a housing to allow the RF connector to float in the connector cavity; and a rear retainer coupled to the rear shell proximate to the rear flange, the rear retainer being axially movable relative to the rear flange, the rear retainer being rotatably fixed relative to the rear flange, the rear retainer having a front rim, the spring being spring biased against the front rim, wherein the front flange is configured to be received in the connector cavity of the housing such that the front rim engages a rear wall of the housing to axially position the rear retainer relative to the housing.

16. The RF connector of claim 15, wherein each opening includes a cutout and a land adjacent the cutout of the rear wall, the rear retainer having a lobe on the front rim, the lobe being received in the cutout, the rear retainer being rotated relative to the housing to offset the lobe from the cutout such that the front rim engages the rear wall.

17. The RF connector of claim 15, wherein the shell includes a key and the rear retainer includes a keyway receiving the key, the key being movable in the keyway to allow axial movement of the shell relative to the rear retainer, the key engaging the rear retainer to restrict rotational movement of the shell relative to the rear retainer.

18. The RF connector of claim 15, wherein the rear retainer is configured to be released from the rear wall from an engaged position to a clearance position by axially shifting the rear retainer forward to separate the front rim from the rear wall and by rotatably shifting the rear retainer relative to the rear wall.

19. The RF connector of claim 15, wherein front flange includes an outer edge configured to face a side wall of the connector cavity and configured to engage the side wall to center the RF connectors in the corresponding connector cavity for mating with the corresponding electrical connector.

20. An RF module comprising:

a housing having cavity walls defining connector cavities and a rear wall at a rear of the connector cavities, the rear wall having a plurality of openings therethrough open to corresponding connector cavities, the connector cavities being open opposite the rear wall to receive electrical connectors in corresponding connector cavities;

RF connectors received in the connector cavities, the RF connectors being terminated to corresponding cables, each RF connector having a conductive shell, a center contact and a dielectric body positioning the center contact in the shell, the shell having a front flange and a rear flange, the front flange having an outer edge facing the corresponding side wall and configured to engage the side wall to center the RF connector in the corresponding connector cavity for mating with the corresponding electrical connector, the RF connector having a spring surrounding the shell between the front flange and the rear flange, the RF connector having a rear retainer at the rear flange, the rear retainer having a front rim, the RF connector being received in the corresponding opening such that the front rim of the rear retainer engages the rear wall to retain the RF connector in the corresponding opening, the RF connector being spring loaded in the connector cavity to allow the RF connector to float in the connector cavity.

21. An RF module comprising:

a housing having walls defining connector cavities extending between a mating end and a rear wall, the rear wall having a plurality of openings therethrough, the connector cavities being open at the mating end to receive electrical connectors;

RF connectors received in the connector cavities, the RF connectors being terminated to corresponding cables, each RF connector having a conductive shell, a center contact and a dielectric body positioning the center contact in the shell, the shell having a front flange and a rear flange, the RF connector having a spring surrounding the shell between the front flange and the rear flange, the RF connector having a rear retainer forward of the rear flange, the rear retainer being secured to the rear wall, the RF connector being received in the corresponding opening such that the front flange is located forward of the rear wall in the connector cavity and the rear flange is located rearward of the rear wall, the front flange having a plurality of projections extending to an outer edge of the front flange, the projections facing the walls of the housing defining the corresponding connector cavity to prevent significant lateral movement of the RF connector in the connector cavity, the RF connector being spring loaded in the connector cavity to allow the RF connector to axially float in the connector cavity.

22. The RF module of claim 21, wherein the rear retainer is a snap ring snapably coupled to the rear wall.

23. The RF module of claim 21, further comprising a removal tool having a hollow cylindrical body extending between a front and a rear, the removal tool having channels extending from the front, the removal tool being loaded into the connector cavity through the mating end to release the rear retainer to remove the RF connector from the housing, the channels receiving the projections.

* * * * *